United States Patent [19]

Borton et al.

[11] 4,033,771

[45] July 5, 1977

[54] STABILIZED BLEACH-FIXING BATHS

[75] Inventors: Gary L. Borton, Penfield; Cobb S. Goff, Rochester; Richard J. Malloy, Webster, all of N.Y.

[73] Assignee: Eastman Kodak Company, Rochester, N.Y.

[22] Filed: Aug. 16, 1973

[21] Appl. No.: 389,063

[52] U.S. Cl. ..... 96/60 BF

[51] Int. Cl.[2] ..... G03C 5/32

[58] Field of Search ..... 96/60 BF

[56] References Cited

UNITED STATES PATENTS

| | | | |
|---|---|---|---|
| 3,304,179 | 2/1967 | Field et al. | 96/61 R |
| 3,615,513 | 10/1971 | Haisl et al. | 96/61 M |
| 3,617,283 | 11/1971 | Ohi et al. | 96/60 BF |
| 3,667,950 | 6/1972 | Amano et al. | 96/60 R |
| 3,667,952 | 6/1972 | Fassbender | 96/22 |
| 3,706,561 | 12/1972 | Mowrey et al. | 96/60 R |
| 3,767,401 | 10/1973 | Newman et al. | 96/60 R |
| 3,879,202 | 4/1975 | Yamaguchi et al. | 96/22 |

*Primary Examiner*—Mary F. Kelley

*Attorney, Agent, or Firm*—A. P. Lorenzo

[57] ABSTRACT

A bleach-fix composition for use in photographic processing comprising a polycarboxylic acid bleaching agent, a thiosulfate fixing agent, and a carbonyl bisulfite adduct. The carbonyl bisulfite adduct functions as a stabilizing agent which retards sulfurization of the bleach-fix composition and thereby prolongs its useful life.

27 Claims, No Drawings

STABILIZED BLEACH-FIXING BATHS

This invention relates in general to photography and in particular to compositions and methods employed in the processing of photographic elements. More specifically, this invention relates to bleach-fix compositions for use in photographic processing which contain a stabilizing agent which retards sulfurization.

Combined bleaching and fixing compositions for use in photography, commonly referred to as bleach-fix compositions, have been known for many years. They are used in processing silver halide photographic materials to simultaneously accomplish the steps of bleaching and fixing and thereby eliminate one step in the conventional processing procedure. The essential components of a bleach-fix composition are the bleaching agent, i.e. an agent which oxidizes the metallic silver in the silver image to a soluble form, and the fixing agent, i.e., an agent which dissolves the undeveloped silver halide and the silver salts formed by the action of the bleaching agent. While a large number of different bleach-fixed compositions are known to the art, of particular importance because of their relatively good stability and the excellent results obtaind therewith are bleach-fix compositions in which the bleaching agent is a polycarboxylic acid bleaching agent and the fixing agent is a thiosulfate fixing agent.

Bleach-fix compositions containing a polycarboxylic acid bleaching agent and a thiosulfate fixing agent have many advantageous characteristics but suffer from the disadvantage that they tend to sulfurize on keeping. Sulfurization, which results from the decomposition of the thiosulfate fixing agent to form sulfur, is accelerated by contact of the bleach-fix with the oxygen of the air and by increases in temperature. Sulfurization typically proceeds in a rather rapid manner so that in a manner of a few hours or days a bleach-fix bath which is not protected against sulfurization will no longer function to bleach-fix a photographic element. It is known to employ an alkali metal bisulfite, such as sodium bisulfite, to retard sulfurization of bleach-fix compositions. However, when this agent is used in amounts sufficient to be effective for this purpose it tends to retard the bleaching action so as to increase the time necessary for bleach-fixing. Moreover, in processing of silver halide photographic elements in which a dye image is formed by development with an aromatic primary amino color development agent in the presence of a dye-forming coupler, the presence of an alkali metal bisulfite in the bleach-fix in amounts necessary to effectively retard sulfurization leads to leuco cyan dye formation, i.e. to formation of the cyan image dyes in their leuco form which creates undesirable sensitometric effects due to the decrease in cyan dye density in the processed element.

It has now been discovered that carbonyl bisulfite adducts will effectively retard sulfurization of bleach-fix compositions containing a polycarboxylic acid bleaching agent and a thiosulfate fixing agent. Accordingly, the present invention provides novel bleach-fix compositions which comprise a polycarboxylic acid bleaching agent, a thiosulfate fixing agent, and a carbonyl bisulfite adduct in an amount sufficient to retard sulfurization of the bleach-fix.

Carbonyl bisulfite adducts have been frequently utilized in the photographic art heretofore. For example, they have been incorporated in silver halide gelatin emulsion layers and in developers as hardening agents for gelatin. As disclosed in U.S. Pat. No. 3,304,179 it is also known to employ carbonyl bisulfite adducts as hardeners for gelatin by incorporating them in non-acidic fixing baths. Aldehydes have also been employed in the prior art as components of bleach-fix compositions to thereby form hardening bleach-fix baths. For example, U.S. Pat. No. 3,667,950 describes a hardening bleach-fix containing a ferricyanide bleaching agent, a thiocyanate fixing agent and an aldehyde hardening agent and Belgian patent 778,273 describes a hardening bleach-fix containing a polycarboxylic acid bleaching agent, sodium thiosulfate as a fixing agent, and an aldehyde as a gelatin-hardening agent. However, in the present invention, the carbonyl bisulfite adduct is not employed for the purpose of hardening gelatin but has been unexpectedly found to retard sulfurization of bleach-fix compositions and is, accordingly, incorporated in such compositions as a stabilizing agent or preservative. Thus, the present invention comprises a method of increasing the resistance to sulfurization of a photographic bleach-fix composition which comprises incorporating in such composition an effective amount of a carbonyl bisulfite adduct.

As described hereinabove, the bleach-fix compositions of this invention contain a polycarboxylic acid bleaching agent. Such bleaching agents are well known and a wide variety of specific compounds can be used. They are typically employed in the form of complex compounds of metals such as iron or cobalt. Aminopolycarboxylic acid bleaching agents and especially ferric aminopolycarboxylic acid complexes are of particular importance. They are utilized in the form of water-soluble salts, such as ammonium or alkali metal salts, of the ferric aminopolycarboxylic acid complex. Typical examples which are widely used in the photographic art are sodium or ammonium salts of ferric ethylenediaminetetraacetic acid. Many other aminopolycarboxylic acids in addition to ethylenediaminetetraacetic acid are also useful such as, for example, nitrilotriacetic acid,
diethylenetriamine pentaacetic acid,
ortho-diamine cyclohexane tetraacetic acid,
ethylene glycol bis(aminoethyl ether)tetraacetic acid,
diaminopropanol tetraacetic acid,
N-(2-hydroxyethyl)ethylenediamine triacetic acid,
ethyliminodipropionic acid, and the like.

Polycarboxylic acids which do not contain amino groups, such as citric or tartaric acids, also form ferric complexes which are useful as bleaching agents in the bleach-fix compositions of this invention. Of the aminopolycarboxylic acids, the aminopolyacetic acids are especially preferred as they are readily available and provide particularly good bleaching action.

The bleach-fix compositions of this invention are compositions which contain a water-soluble thiosulfate which serves as the fixing agent. As is well known, thiosulfates which are useful for this purpose include ammonium thiosulfate and alkali metal thiosulfates such as sodium thiosulfate and potassium thiosulfate.

The carbonyl bisulfate adducts which are useful in this invention contain at least two carbon atoms in the molecule. Adducts of aldehydes and adducts of ketones are useful and the aldehydes employed can be monoaldehydes, dialdehydes or trialdehydes and the ketones can be monoketones, diketones or triketones. The bisulfite adducts can be adducts of alkali metal bisulfites, alkaline earth metal bisulfites or nitrogen-base bisulfites, such as ammonium bisulfite or amine bisulfites.

Carbonyl bisulfite adducts which provide especially advantageous results include those of the formula:

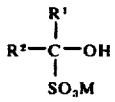

I.

wherein $R^1$ is a hydrogen atom or an alkyl group of 1 to 8 carbon atoms, $R^2$ is an alkyl group of 1 to 8 carbon atoms, and M is an alkali metal.

A class of carbonyl bisulfite adducts within the scope of formula I above which is especially preferred are the aldehyde bisulfite adducts of the formula:

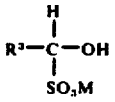

II.

wherein $R^3$ is an alkyl group of 1 to 4 carbon atoms and M is an alkali metal.

A further class of carbonyl bisulfite adducts within the scope of formula I above which is especially preferred are the ketone bisulfite adducts of the formula:

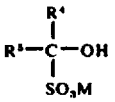

III.

wherein $R^4$ and $R^5$ are alkyl groups of 1 to 4 carbon atoms and M is an alkali metal.

The carbonyl bisulfite adducts of formula I above contain only one bisulfite radical in the molecule. Good results are also obtained with carbonyl bisulfite adducts which contain two bisulfite radicals in the molecule and particularly with carbonyl bis-bisulfite adducts of the formula:

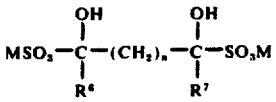

IV.

wherein $R^6$ and $R^7$ are hydrogen atoms or alkyl groups of 1 to 8 carbon atoms, $n$ is an integer having a value of from 0 to 6, and M is an alkali metal.

A class of carbonyl bis-bisulfite adducts within the scope of formula IV above which is especially preferred are the dialdehyde bis-bisulfite adducts of the formula:

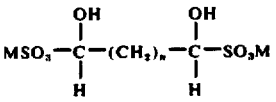

V.

wherein $n$ is an integer having a value of from 1 to 4 and M is an alkali metal.

A further class of carbonyl bis-bisulfite adducts within the scope of formula IV above are the diketone bis-bisulfite adducts of the formula:

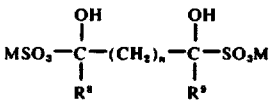

VI.

wherein $R^8$ and $R^9$ are alkyl groups of 1 to 2 carbon atoms, $n$ is an integer having a value of from 1 to 4, and M is an alkali metal.

Illustrative examples of the many carbonyl bisulfite adducts which are useful in the present invention include the following compounds (all of those listed being sodium bisulfite adducts for the purpose of convenience in illustrating the invention but it being understood that the compounds can also be employed in the form of adducts of other suitable bisulfites as explained hereinabove):

sodium acetaldehyde bisulfite,
sodium propionaldehyde bisulfite,
sodium butyraldehyde bisulfite,
succinaldehyde bis-sodium bisulfite,
glutaraldehyde bis-sodium bisulfite,
beta-methyl glutaraldehyde bis-sodium bisulfite,
maleic dialdehyde bis-sodium bisulfite,
sodium acetone bisulfite,
sodium butanone bisulfite,
sodium pentanone bisulfite,
2,4-pentanedione bis-sodium bisulfite, and the like.

Particularly preferred for use as a stabilizer in the bleach-fix compositions of this invention is glutaraldehyde bis-sodium bisulfite. This compound has many advantages including the fact that it is readily available, highly effective as a stabilizer, does not significantly increase bleach-fixing time, does not cause problems of foam formation in the bleach-fix, and does not lead to leuco cyan dye formation in the processing of photographic elements.

The bleach-fix composition of this invention will generally contain about 5 to about 400 grams, and more preferably about 10 to about 200 grams of the polycarboxylic acid bleaching agent per liter of solution, and about 5 to about 400 grams and more preferably about 10 to about 200 grams, of the thiosulfate fixing agent per liter of solution. The carbonyl bisulfite adduct can be used in any amount which is effective to retard the sulfurization of the bleach-fix. Optimum amounts will vary widely depending on the particular composition of the bleach-fix and the conditions under which it is to be employed. Generally speaking, the carbonyl bisulfite adduct will be incorporated in the bleach-fix in an amount of from about 0.01 to about 1 mole per liter of solution, more preferably in an amount of from about 0.02 to about 0.5 moles per liter of solution and most preferably in an amount of from about 0.05 to about 0.25 moles per liter of solution. The carbonyl bisulfite adduct can be formed in situ by addition to the bleach-fix bath of a suitable carbonyl compound, such as a low molecular weight aldehyde or ketone, and a bisulfite compound such as sodium bisulfite, or it can be added to the bleach-fix bath as a preformed adduct.

While the above-described polycarboxylic acid bleaching agents, thiosulfite fixing agents and carbonyl bisulfite adducts are the essential components of the bleach-fix compositions of this invention, these compositions can also contain other addenda known to the art to be useful in a bleach-fix. Thus, for example, they can include an additional silver halide solvent such as a water-soluble thiocyanate, e.g., ammonium thiocyanate, sodium thiocyanate or potassium thiocyanate, as well as such compounds as mercaptotriazoles, alkali metal bromides and alkali metal iodides. They can also contain nonchelated salts of aminopolycarboxylic acids which function as sequestering agents e.g. sodium salts of ethylenediaminetetraacetic acid. The pH of the bleach-fix will typically be in the range from about 4 to about 8, and more preferably about 6 to about 7.

It will frequently be desirable to include a bleach accelerator in the bleach-fix composition to increase the bleaching rate and thereby decrease the time required for bleach-fixing. Many agents are known to be useful for this purpose such as thiourea and iodides. Especially useful bleach accelerating agents are mercaptothiadiazoles of the formula:

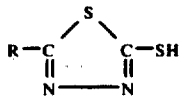

wherein R is a hydrogen atom, an amino group, an alkyl group of 1 to 8 carbon atoms and preferably of 1 to 4 carbon atoms, or an alkylamino group wherein each alkyl radical contains 1 to 8 carbon atoms and preferably 1 to 4 carbon atoms.

While the mechanism whereby the present invention functions is not known with certainty it is believed that the carbonyl bisulfite adduct continuously supplies the bleach-fix composition with a small steady-state concentration of bisulfite ion which is large enough to retard sulfurizing but, unlike the large quantity of free bisulfite ion supplied by an alkali metal bisulfite, not so large as to retard the bleaching action or cause leuco cyan dye formation. The carbonyl bisulfite adducts do not adversely react with or significantly interfere with the activity of either the polycarboxylic acid bleaching agent or the fixing agent. They are especially useful with bleach-fix compositions employed in processes operated at elevated temperatures, such as temperatures in excess of 100° F, because sulfurization is an especially severe problem at such elevated temperatures.

The bleach-fix compositions described herein can be used in the processing of photographic elements designed for reversal color processing or in the processing of negative color elements or color print materials. They can be employed with photographic elements which are processed in color developers containing couplers or with photographic elements which contain the coupler in the silver halide emulsion layers or in layers contiguous thereto. The photosensitive layers present in the photographic elements processed in accordance with this invention can contain any of the conventional silver halides as the photosensitive material, for example, silver chloride, silver bromide, silver bromoiodide, silver chlorobromide, silver chloroiodide, silver chlorobromoidide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

The invention is further illustrated by the following examples of its practice.

EXAMPLE 1

A bleach-fix solution having a pH of 6.8 was prepared as follows:

| | |
|---|---|
| Ammonium thiosulfate (58% by weight aqueous solution | 100 ml. |
| *$NH_4FeEDTA$ (1.56 molar aqueous solution) | 250 ml. |
| 5-amino-1,3,4-thiadiazole-2-thiol (10% by weight aqueous solution | 17.5 ml. |
| Sodium acetaldehyde bisulfite | 0.18 moles |
| Water to one liter | |

*ammonium salt of ferric ethylenediaminetetraacetic acid.

A test of the stability of the bleach-fix under conditions designed to accelerate the rate of sulfurization was carried out by bubbling air through a one-liter sample of the bleach-fix solution at a rate of 0.2 liters per minute while maintaining the bleach-fix solution at a temperature of 61.2° C. The time required for sulfurization to occur was determined by taking photographs of the solution using a time-lapse camera. Sulfurization results in a turbid solution and precipitation of sulfur in the solution and the time at which it occurs can be readily determined by observing the solution or by taking photographs with a time-lapse camera. With the bleach-fix solution containing 0.18 moles per liter of sodium acetaldehyde bisulfite as a stabilizer the time required for sulfurization to occur was 41 hours.

In contrast with the above results, when the identical test procedure was carried out using the same bleach-fix solution except that the sodium acetaldehyde bisulfite was omitted the time for sulfurization to occur was 2 hours and 20 minutes. A second identical test except that 0.18 moles per liter of sodium formaldehyde bisulfite was employed as the stabilizer was carried out and in this test the time for sulfurization to occur was 4 hours. Carbonyl bisulfite adducts which are employed in accordance with the present invention are those which contain at least two carbon atoms in the molecule and sodium formaldehyde bisulfite contains only one carbon atom and is thus outside the scope of the invention disclosed and claimed herein. A third identical test except that 0.19 moles per liter of sodium bisulfite was employed as the stabilizer was also carried out and the time for sulfurization to occur was 24 hours. It is thus apparent that sodium acetaldehyde bisulfite retards stabilization more effectively than sodium bisulfite. Moreover, when employed at this concentration, sodium bisulfite increases bleach-fixing time and leads to leuco cyan dye formation, whereas sodium acetaldehyde bisulfite exhibits neither of these disadvantages.

EXAMPLE 2

A bleach-fix solution identical to that described in Example 1 except that it contained 0.09 moles per liter of glutaraldehyde bis-sodium bisulfite as the stabilizer, and was thus on an equinormal basis in bisulfite ion with the solution of Example 1, was tested in the same manner described in Example 1. The time for sulfurization to occur was 31 hours. In contrast with these results when the 0.09 moles of glutaraldehyde bis-sodium bisulfite was replaced by 0.09 moles of glutaraldehyde, sulfurization occurred within a few minutes thus showing that glutaraldehyde not only does not retard sulfurization but promotes it.

EXAMPLE 3

A bleach-fix solution identical to that described in Example 1 except that it contained 0.09 moles of succinaldehyde bis-sodium bisulfite as stabilizer was tested in the same manner described in Example 1. The time for sulfurization to occur was 28 hours. Foaming occurred shortly before the solution sulfurized while this was not observed to occur with the other carbonyl bisulfite adducts tested.

EXAMPLE 4

A bleach-fix solution identical to that described in Example 1 except that it contained 0.18 moles of sodium acetone bisulfite as stabilizer was tested in the same manner described in Example 1. The time for sulfurization to occur was 23 hours.

EXAMPLE 5

A bleach-fix solution identical to that described in Example 1 except that it employed 2,4-pentanedione bis-sodium bisulfite as stabilizer was tested in the same manner described in Example 1. In this test, 0.09 moles of 2,4-pentanedione and 0.09 moles of sodium metabisulfite were stirred together overnight in an aqueous solution to form the 2,4-pentanedione bis-sodium bisulfite and the resulting homogeneous solution was then added to the bleach-fix solution. The time for sulfurization to occur was 28 hours.

EXAMPLE 6

A bleach-fix solution having a pH of 6.8 was prepared as follows:

| | |
|---|---|
| Ammonium thiosulfate (60% by weight aqueous solution | 75 ml. |
| $NH_4FeEDTA$ (1.56 molar aqueous solution) | 250 ml. |
| 5-amino-1,3,4-thiadiazole-2-thiol | 1.0 g. |
| Succinaldehyde bis-sodium bisulfite | 0.2 moles |
| Water to one liter | |

The fresh bleach-fix solution and solutions which had been stored for varying lengths of time in sealed containers maintained at 52° C were tested for the ability to clear, i.e. bleach and fix, a multilayer gelatin silver halide color reversal film. The bleach-fix described above cleared the film after four weeks of storage whereas the same bleach-fix from which the succinaldehyde bis-sodium bisulfite had been omitted or replaced by an equivalent amount of sodium bisulfite did not clear after 1 week.

EXAMPLE 7

A bleach-fix solution having a pH of 7.0 was prepared as follows:

| | |
|---|---|
| Ammonium thiosulfate (60% by weight aqueous solution) | 125 ml. |
| $NH_4FeEDTA$ (1.56 molar aqueous solution) | 90 ml. |
| Disodium salt of ethylenediaminetetraacetic acid | 31 g. |
| Sodium sulfite | 12 g. |
| Potassium iodide | 1 g. |
| Succinaldehyde bis-sodium bisulfite | 0.1 moles |
| Water to one liter | |

Air was bubbled through the bleach-fix solution while it was maintained at a temperature of 60° C. The time for sulfurization to occur was 66 hours. Eliminating the succinaldehyde bis-sodium bisulfite from the solution reduced the time for sulfurization to occur to 24 hours whereas replacing the succinaldehyde bis-sodium bisulfite with an equal number of moles of glutaraldehyde bis-sodium bisulfite increased the time for sulfurization to occur to 83 hours.

EXAMPLE 8

A bleach-fix solution having a pH of 6.45 was prepared as follows:

| | |
|---|---|
| Ammonium thiosulfate (60% by weight aqueous solution) | 172.5 ml. |
| $NH_4FeEDTA$ (1.56 molar aqueous solution) | 115 ml. |
| Glutaraldehyde bis-sodium bisulfite | 0.0625 moles |
| Water to one liter | |

The stability of the bleach-fix under conditions designed to accelerate the rate of sulfurization was determined by bubbling air through a one-liter sample of the bleach-fix solution at a rate of 0.20 liters per minute while maintaining the temperature at a specified level. The time for sulfurization to occur, determined in the manner described in Example 1, was measured for this solution and for similar bleach-fix solutions utilizing the stabilizers and temperatures described in the following table.

| Test | Stabilizer | | Temperature | Sulfurization Time |
|---|---|---|---|---|
| No. | Compound | Moles | (° C) | (hours) |
| 1 | glutaraldehyde bis-sodium bisulfite | 0.0625 | 67.0 | 34 |
| 2 | " | 0.13 | 44.9 | 151 |
| 3 | " | 0.13 | 57.3 | 80 |
| 4 | " | 0.13 | 65.3 | 60 |
| 5 | " | 0.13 | 82.2 | 16 |
| 6 | sodium bisulfite | 0.125 | 67.0 | 23 |
| 7 | " | 0.25 | 45.4 | 66 |
| 8 | sodium bisulfite | 0.25 | 57.2 | 53 |
| 9 | " | 0.26 | 65.7 | 36 |
| 10 | " | 0.25 | 83.0 | 9 |

As shown by the data in the above table, the time for sulfurization to occur decreases rapidly as the temperature is increased. At a given temperature and on an equinormal basis in terms of bisulfite ion, the time for sulfurization to occur is substantially greater using glutaraldehyde bis-sodium bisulfite as the stabilizer as compared to sodium bisulfite.

Extrapolation of the data in the above table by plotting for tests 2 to 5 and 7 to 10 the logarithm of the sulfurization time versus the reciprocal of the temperature in degrees Kelvin indicates that the sulfurization time at a temperature of 25° C will be 700 hours for the solution containing glutaraldehyde bis-sodium bisulfite as compared to 320 hours for the solution containing sodium bisulfite.

The invention has been described in detail with particular reference to preferred embodiments thereof, but it will be understood that variations and modifications can be effected within the spirit and scope of the invention.

We claim:

1. A bleach-fix composition for use in photographic processing, comprising 1. a bleaching agent which is an iron or cobalt complex of a polycarboxylic acid, 2. a thiosulfate fixing agent, and
3. an amount sufficient to retard sulfurization of said bleach-fix composition of a carbonyl bisulfite adduct comprising at least two carbon atoms.

2. A bleach-fix composition as claimed in claim 1 wherein the carbonyl bisulfite adduct is of the formula:

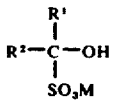

wherein $R^1$ is a hydrogen atom or an alkyl group of 1 to 8 carbon atoms, $R^2$ is an alkyl group of 1 to 8 carbon atoms, and M is an alkali metal.

3. A bleach-fix composition as claimed in claim 1 wherein the carbonyl bisulfite adduct is of the formula:

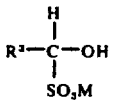

wherein $R^3$ is an alkyl group of 1 to 4 carbon atoms and M is an alkali metal.

4. A bleach-fix composition as claimed in claim 1 wherein the carbonyl bisulfite adduct is of the formula:

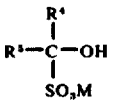

wherein $R^4$ and $R^5$ are alkyl groups of 1 to 4 carbon atoms and M is an alkali metal.

5. A bleach-fix composition as claimed in claim 1 wherein the carbonyl bisulfite adduct is of the formula:

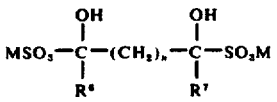

wherein $R^6$ and $R^7$ are hydrogen atoms or alkyl groups of 1 to 8 carbon atoms, *n* is an integer having a value of from 0 to 6, and M is an alkali metal.

6. A bleach-fix composition as claimed in claim 1 wherein the carbonyl bisulfite adduct is of the formula:

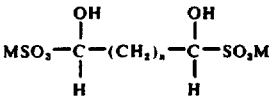

wherein *n* is an integer having a value of from 1 to 4 and M is an alkali metal.

7. A bleach-fix composition as claimed in claim 1 wherein the carbonyl bisulfite adduct is of the formula:

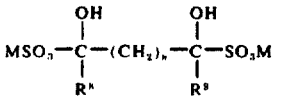

wherein $R^8$ and $R^9$ are alkyl groups of 1 to 2 carbon atoms, *n* is an integer having a value of from 1 to 4 and M is an alkali metal.

8. A bleach-fix composition as claimed in claim 1 wherein the bleaching agent is a ferric complex of an aminopolycarboxylic acid.

9. A bleach-fix composition as claimed in claim 1 wherein the bleaching agent is a ferric complex of an aminopolyacetic acid.

10. A bleach-fix composition as claimed in claim 1 wherein the bleaching agent is a ferric complex of ethylenediaminetetraacetic acid.

11. A bleach-fix composition as claimed in claim 1 wherein the bleaching agent is the ammonium salt of ferric ethylenediamine tetraacetic acid.

12. A bleach-fix composition as claimed in claim 1 wherein the fixing agent is ammonium thiosulfate.

13. A bleach-fix composition as claimed in claim 1 wherein said composition has a pH in the range from about 6 to about 7.

14. A bleach-fix composition as claimed in claim 1 wherein said composition contains a mercaptothiadiazole bleach accelerator.

15. A bleach-fix composition as claimed in claim 1 wherein said composition contains 51,3,4-thiadiazole-2-thiol as a bleach accelerator.

16. A bleach-fix composition as claimed in claim 1 wherein said composition contains said bleaching agent in an amount of about 5 to about 400 grams per liter, said fixing agent in an amount of about 5 to about 400 grams per liter, and said carbonyl bisulfite adduct in an amount of about 0.01 to about 1 mole per liter.

17. A bleach-fix composition as claimed in claim 1 wherein said composition contains said bleaching agent in an amount of about 10 to about 200 grams per liter, said fixing agent in an amount of about 10 to about 200 grams per liter, and said carbonyl bisulfite adduct in an amount of about 0.02 to about 0.5 moles per liter.

18. A bleach-fix composition as claimed in claim 1 wherein said composition contains said bleaching agent in an amount of about 10 to about 200 grams per liter, said fixing agent in an amount of about 10 to about 200 grams per liter, and said carbonyl bisulfite adduct in an amount of about 0.05 to about 0.25 moles per liter.

19. A bleach-fix composition as claimed in claim 1 wherein said carbonyl bisulfite adduct is sodium acetaldehyde bisulfite.

20. A bleach-fix composition as claimed in claim 1 wherein said carbonyl bisulfite adduct is succinaldehyde bis-sodium bisulfite.

21. A bleach-fix composition as claimed in claim 1 wherein said carbonyl bisulfite adduct is glutaraldehyde bis-sodium bisulfite.

22. A bleach-fix composition for use in photographic processing comprising ammonium thiosulfate, the ammonium salt of ferric ethylenediaminetetraacetic acid, and sodium acetaldehyde bisulfite in an amount sufficient to retard sulfurization of said composition.

23. A bleach-fix composition for use in photographic processing comprising ammonium thiosulfate, the ammonium salt of ferric ethylenediaminetetraacetic acid, and glutaraldehyde bis-sodium bisulfite in an amount sufficient to retard sulfurization of said composition.

24. A method of increasing the resistance to sulfurization of a photographic bleach-fix composition containing a bleaching agent which is an iron or cobalt complex of a polycarboxylic acid and a thiosulfate fixing agent, which method comprises incorporating therein an effective amount of a carbonyl bisulfite adduct comprising at least two carbon atoms.

25. A method as claimed in claim 24 wherein said bleaching agent is the ammonium salt of ferric ethylenediamine tetraacetic acid.

26. A method as claimed in claim 24 wherein said fixing agent is ammonium thiosulfate.

27. A method as claimed in claim 24 wherein said carbonyl bisulfate adduct is glutaraldehyde bis-sodium bisulfite.

* * * * *